US005275186A

United States Patent [19]

Liu

[11] Patent Number: 5,275,186

[45] Date of Patent: Jan. 4, 1994

[54] FASTENING ASSEMBLY FOR AN UMBRELLA

[76] Inventor: Fu-Hai Liu, Suite 1, 11F, 95-8 Chang Ding Road, Sec. 1, Taichung, Taiwan

[21] Appl. No.: 994,411

[22] Filed: Dec. 21, 1992

[51] Int. Cl.[5] ..... A45B 25/14

[52] U.S. Cl. ..... 135/24; 135/25.4; 135/38

[58] Field of Search ..... 135/15.1, 22, 24, 25.4, 135/25.41, 37, 38

[56] References Cited

U.S. PATENT DOCUMENTS

| | | | |
|---|---|---|---|
| 4,534,374 | 8/1985 | Day | 135/24 X |
| 4,989,625 | 2/1991 | Wu | 135/24 X |
| 5,020,558 | 6/1991 | Huang | 135/24 |
| 5,144,969 | 9/1992 | Chou et al. | 135/24 X |
| 5,161,562 | 11/1992 | Wu | 135/24 X |

FOREIGN PATENT DOCUMENTS

| | | | |
|---|---|---|---|
| 1595442 | 9/1990 | U.S.S.R. | 135/24 |
| 2113991 | 8/1983 | United Kingdom | 135/24 |

*Primary Examiner*—Carl D. Friedman
*Assistant Examiner*—Lan M. Mai

[57] ABSTRACT

A fastening assembly for an umbrella comprising a runner mounted with a fastening device and an inner seat including a push button mounted thereon is disclosed. The fastening portion of the push button engages with either the fastening holes or the fastening edges. The inner seat is placed within the handle of the umbrella such that the pressing portion is close to the circumferential edge of the handle facilitating the opening of the umbrella.

5 Claims, 6 Drawing Sheets

FASTENING ASSEMBLY FOR AN UMBRELLA

BACKGROUND OF THE INVENTION

The present invention relates to a fastening assembly for an umbrella comprising a runner mounted with a fastening device, and an inner seat including a push button being mounted thereon by the peg. The fastening portion of the push button engages with either the fastening holes or the fastening edges. The inner seat is placed within the handle of the umbrella so that the pressing portion is close to the circumferential edge of the handle facilitating the opening of the umbrella.

The use of a self-put up umbrella is very common especially in the tropical countries. On this conventional umbrella assembly, a push button is mounted onto the handle of the umbrella. The center region of the button is hollow for the mounting of the main shaft. Under the push button is provided a spring to cause the push button to release the runner. The spring is partially formed like a hook having inclined face to engage with the fastening hole or edge on the runner so as to function to open the umbrella and to function to keep the umbrella closed. Owing to the fact that the push button is provided at the center region of the handle, a great force must be applied to compress the spring in order to open the umbrella. Thus, the applying of force to open the umbrella is not convenient.

SUMMARY OF THE INVENTION

It is therefore the main object of the present application to provide a fastening assembly of an umbrella having a new push button designed to provide convenience to open the umbrella and the fastening of the umbrella.

It is another object of the present invention to provide a fastening assembly including an inner seat mounted with a push button having a fastening portion and a runner having fastening holes or engaging edges to engage with said fastening portion.

It is therefore another object of the present application to provide a fastening assembly of an umbrella, wherein when an external force is exerted to cause a great shaking to the umbrella, an upward thrust is exerted to the runner, and the fastening holes or the fastening edges will engage with the fastening portion of the spring. The greater the upward force is exerted on the runner, the greater is the downward torque of the fastening portion. Thus, the fastened umbrella will not be opened accidentally as a result of the shaking of the umbrella.

It is therefore yet another object of the present application to provide a fastening assembly of an umbrella which provides a great convenience in fastening a closed umbrella.

The features of the present invention will be more fully understood and appreciated with reference to the written specification.

DETAILED DESCRIPTION OF THE INVENTION

Figure 1:
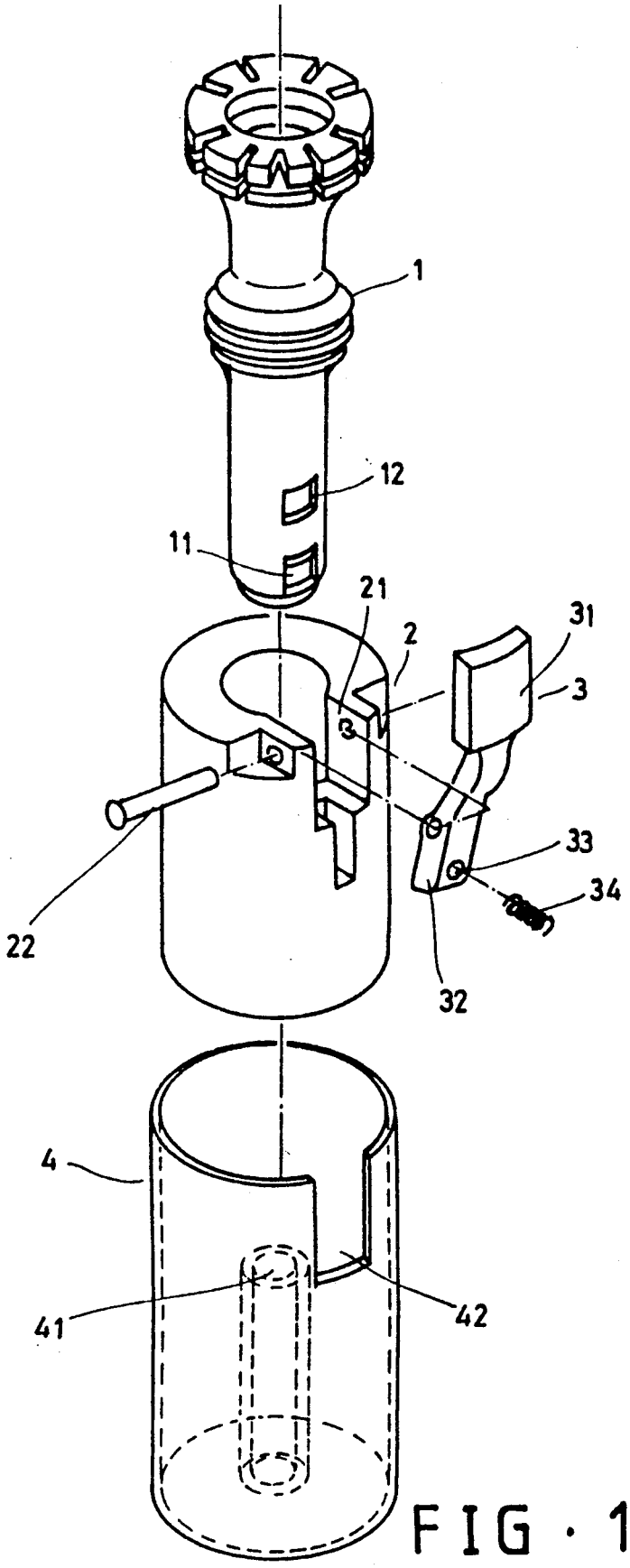
FIG. 1 is a perspective, exploded view of a fastening assembly in accordance with the present invention.
Figure 2:
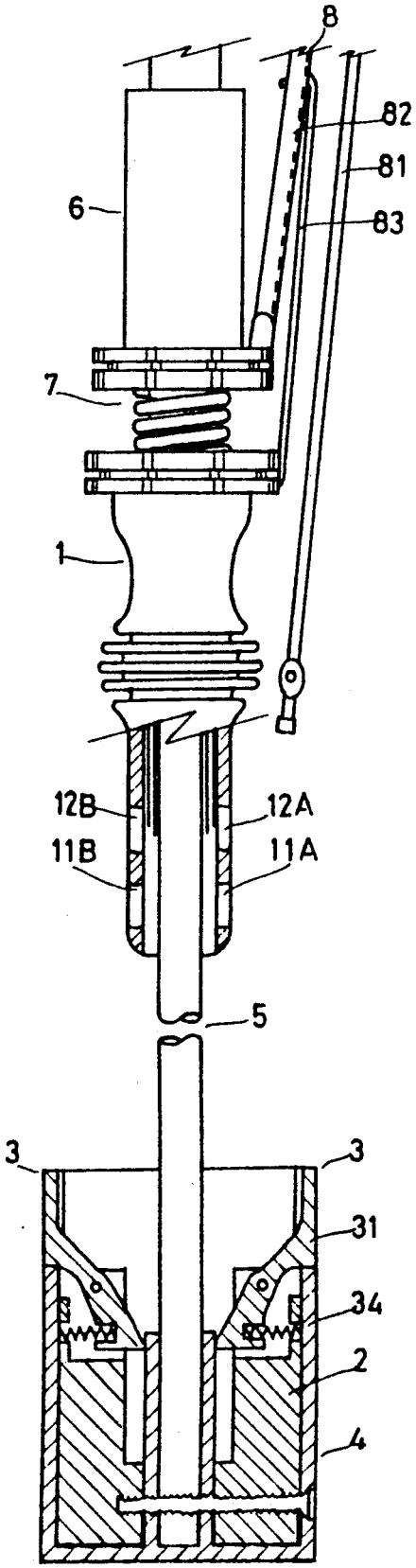
FIG. 2 is a sectional view showing the position of the runner having fastening holes thereon, the runner being at the top of the handle.
Figure 4:
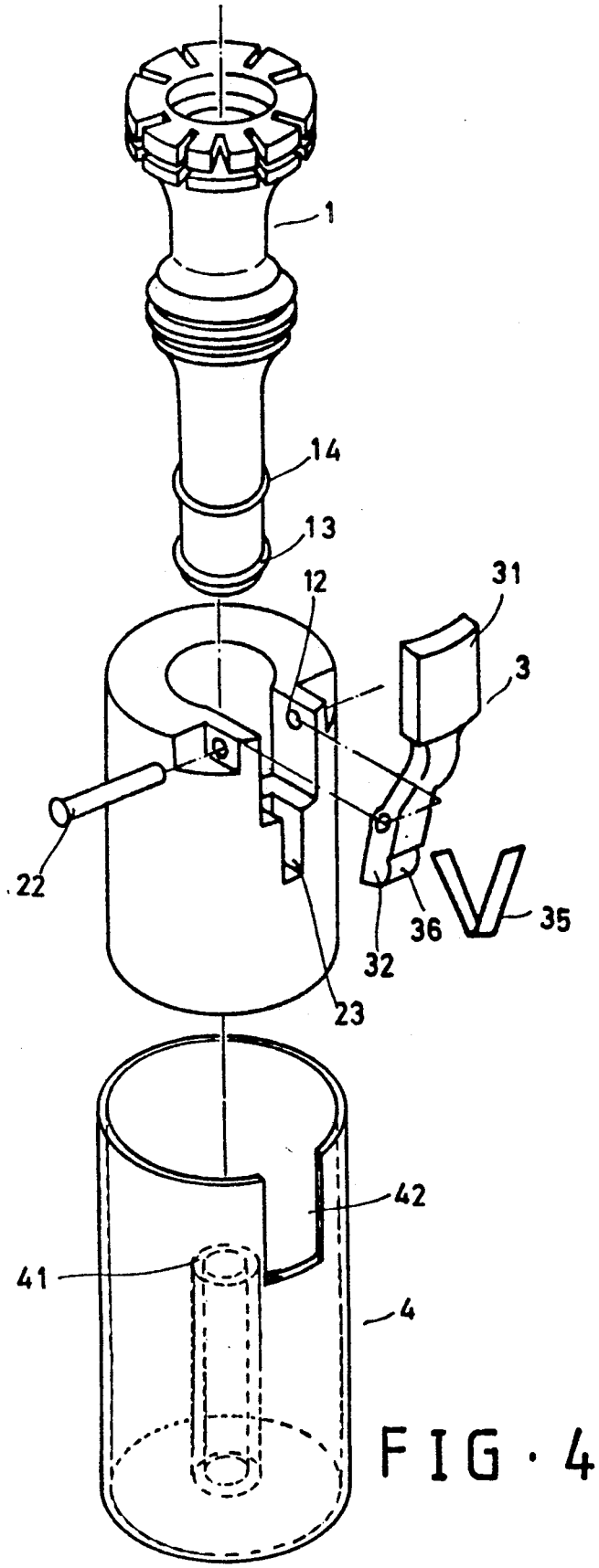
FIG. 4 is another perspective, exploded view of a fastening assembly in accordance with the present invention.

Referring to FIGS. 1 and 2, in particular to FIG. 1. There is shown a fastening assembly of an umbrella comprising a runner having two fastening holes 12, a handle 4, and an inner seat 2 including a push button 3 being mounted thereon by a peg 22. The runner 1 is substantially cylindrical and is provided with a first fastening hole 11 and a second fastening hole 12 at the lower end of the runner 1. These fastening holes 11, 12 can also be replaced by fastening edges 13 or 14, as shown in FIG. 4, for the engagement with the fastening portion 32 of the push button 3. The details of which will be explained hereinafter. As shown in FIG. 1, the inner seat 2 is substantially a short hollow cylindrical 2 having one circumferential edge is cut to form a channel 21. A push button 3 having a pressing portion 31 at one end and a fastening portion 32 at the other end. A recess 33 for the mounting of a spring 34 is provided on the push button 3. The push button 3 is pivotally mounted to the inner seat 2 at the channel 21 at an appropriate position by means of the peg 22 so that the push button 3 pivots on the peg 22. The free end of the spring 34 mounted onto the recess 33 urges the inner wall of the handle 4 of the umbrella.

The handle 4 is a hollow cylindrical shape adaptable to the mounting of the inner seat 2. In order to accommodate the inner seat 2, the top circumferential edge of the handle 4 is designed with a long notch 42 so as to conform the shape of the pressing portion 31 of the push button 3. After the pressing portion 31 has been mounted, the handle 4 is formed as an unit with the inner seat 2. The center of the handle 4 is provided with a securing hole 41 for the mounting of the shaft 5 of the umbrella.

The push button 3 can be mounted to either one or two lateral sides of the inner seat 2. As shown in FIG. 2, a pair of push buttons 3 are mounted in directly opposite at the circumferential edge such that the pressing down of the push button 3 will release the closed umbrella. As a result, the fastening assembly in accordance with the present invention provides further safety to the use of the umbrella.

Figure 3:
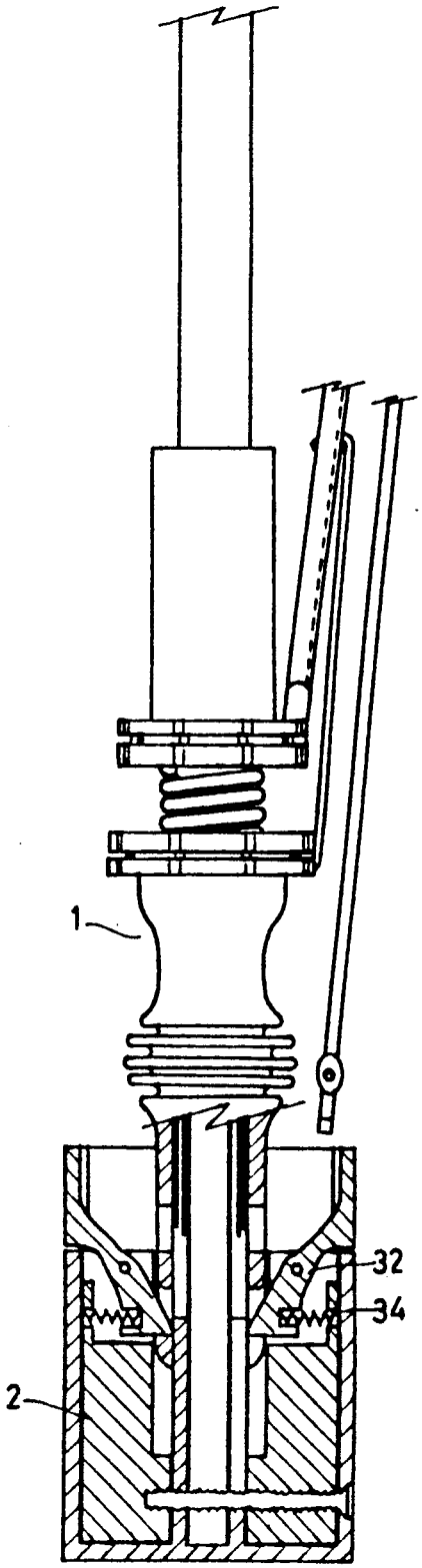
FIG. 3 is a sectional view showing the fastening portion of the push button being pressed into the fastening hole of the runner in accordance with the present invention.

FIG. 2 is a sectional view showing the position of the runner 1 having two fastening holes 11*a*, 11*b*, 12*a*, 12*b*, thereon. In the figure, the umbrella frame 8, the auxiliary runner 6 and the main spring 7 can be seen. Before the frame 8 is closed, the push button 3 combined with the handle 4 as one unit and the spring 34 is in an extended state. When the umbrella is closed, the fastening portion 32 of the push button 3 passes respectively the first fastening hole 11 and the second fastening hole 12. During the process of closing the umbrella, the lower portion of the runner inserts into the inner seat 2 and when the lower portion touches the fastening portion 32, the spring 34 will be compressed. The spring 34 will only restore to its original state when the fastening portion 32 engages with the fastening hole 11 or 12. This can be seen from FIG. 3, where FIG. 3 is a sectional view showing the fastening portion 32 of the push button 3 being pressed into the fastening hole 11 of the runner 1 in accordance with the present invention.

FIG. 4 is another perspective, exploded view of a fastening assembly in accordance with the present invention. As can be seen in the figure, the spring 34 can be replaced with a "V" shaped elastic member 35. At the rear face of the fastening portion 32, an engaging region 36 is provided for use to avoid the dislocation of the "V" shaped elastic members 35. The "V" shaped elastic member 35 is placed in between the engaging region 36 and the inner wall of the handle 4. In order to place the "V" shaped elastic member 35, a slot 23 is provided on the inner seat 2.

Figure 5:
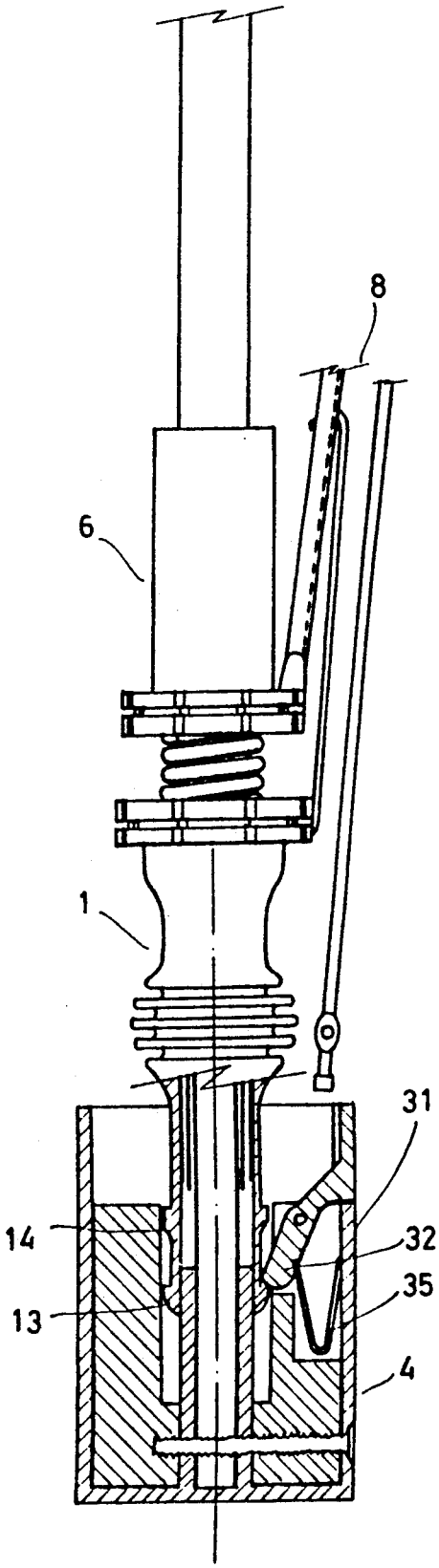
FIG. 5 is a schematic view showing the fastening portion of the push button being pressed to the first fastening edge provided on the runner in accordance with the present invention.
Figure 6:
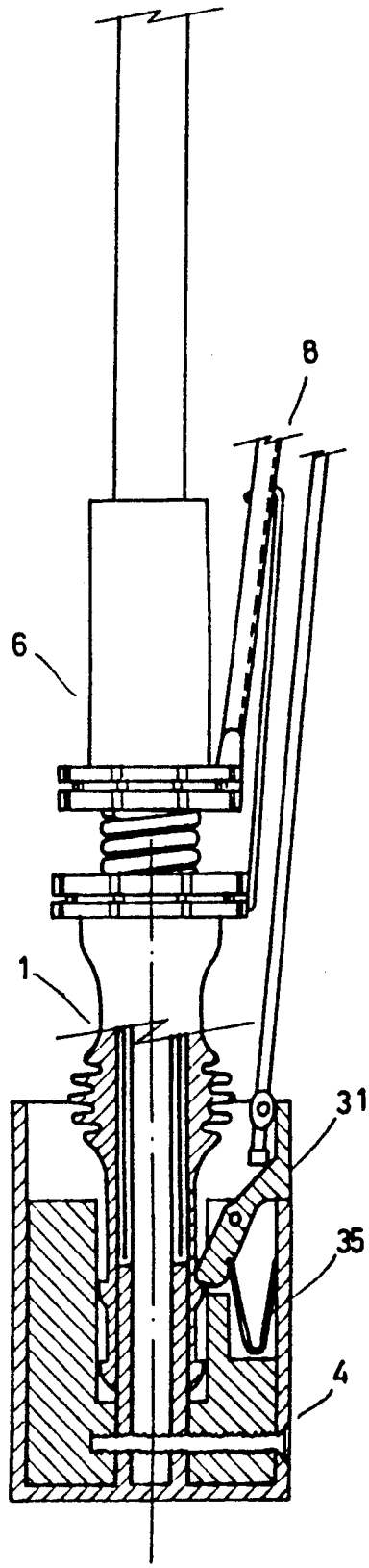
FIG. 6 is a schematic view showing the fastening portion of the push button being pressed to the second fastening edge provided on the runner in accordance with the present invention.

FIG. 5 is a schematic view showing the fastening portion 32 of the push button 3 being pressed to the first fastening edge 13 provided on the runner 1 and FIG. 6 is a schematic view showing the fastening portion 32 of the push button 3 being pressed to the second fastening edge 14 provided on the runner 1 in accordance with the present invention.

Figure 7:
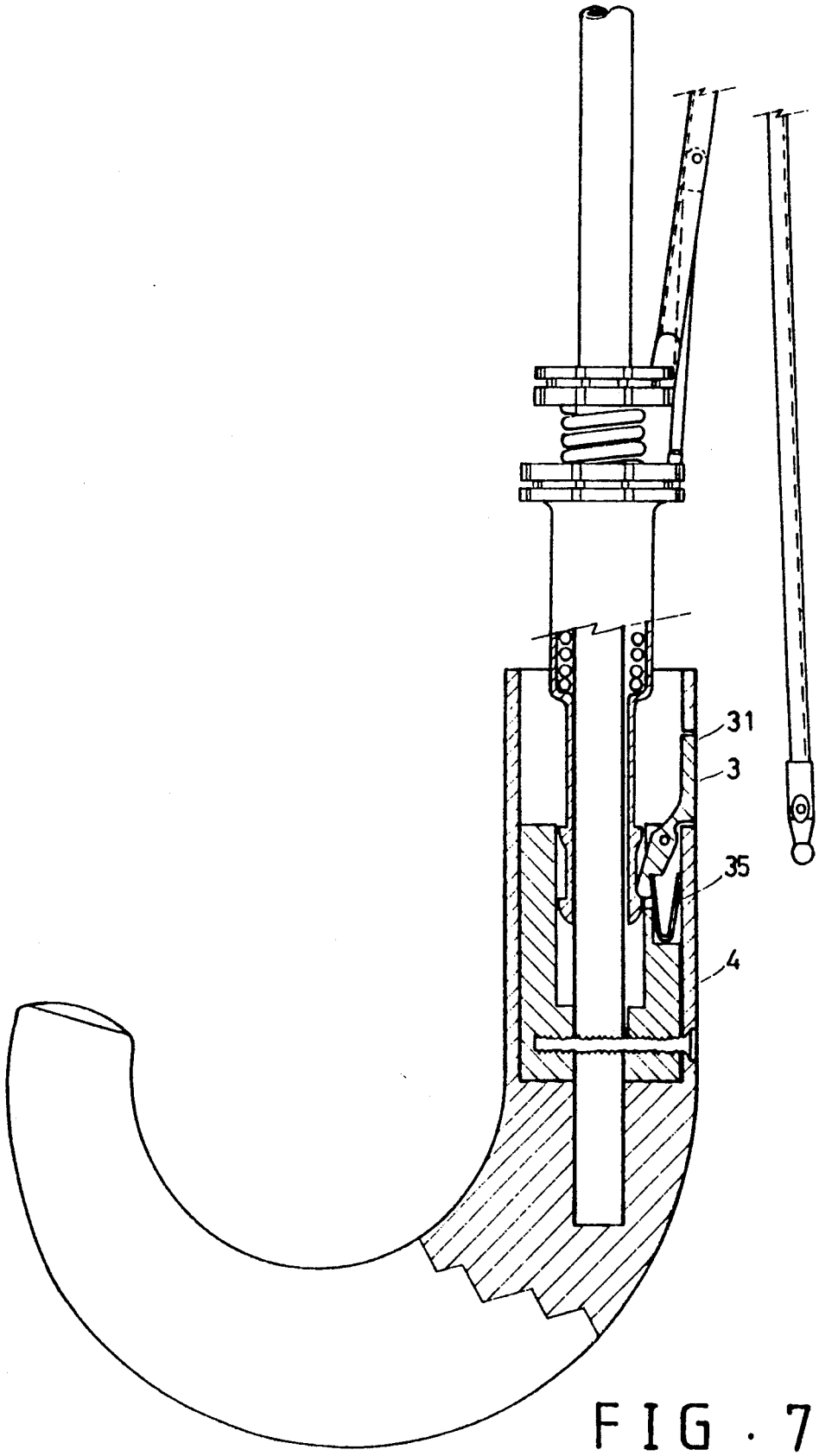
FIG. 7 is a sectional view showing the fastening assembly used in umbrella which has only one closing function.
Figure 8:
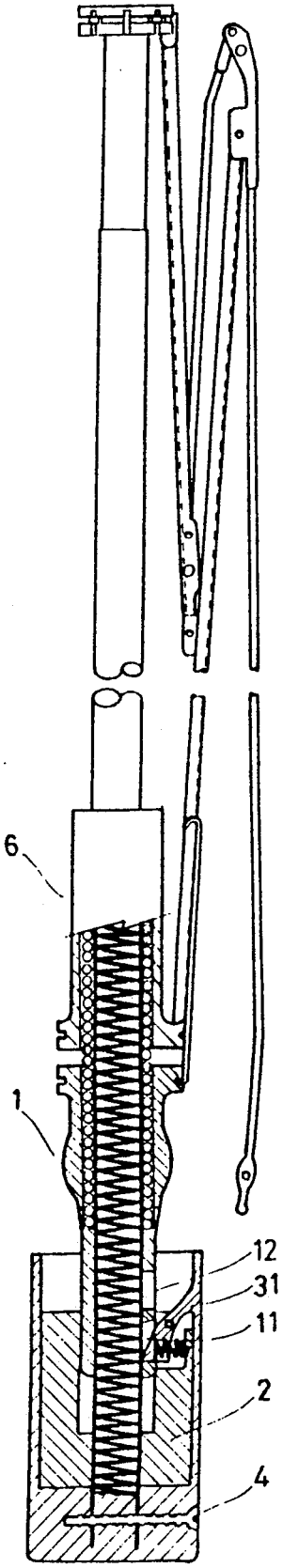
FIG. 8 is a sectional view of the preferred embodiment in accordance with the present invention.
Figure 9:
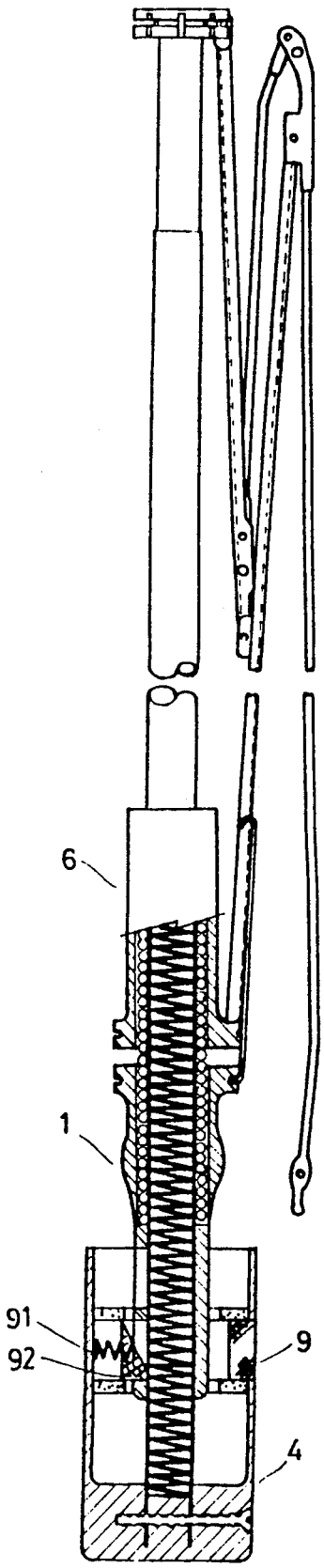
FIG. 9 is a fastening assembly of a prior art.

FIG. 7 is a sectional view showing the fastening assembly used in stick type umbrella. FIG. 8 is a sectional view of the preferred embodiment in FIG. 7. The inner seat 2 is mounted within the handle 4 and the push button 3 is provided in an appropriate position for pressing so as to open the umbrella.

It is to be understood that various modifications, additions and/or alterations may be made to the parts previously described without departing from the ambit of the present invention.

I claim:

1. A fastening assembly for an umbrella having an inner seat, a handle, and a runner provided with fastening device characterized in that a push button is pivotally mounted with a peg on a channel provided at the circumferential edge of the inner seat, a pressing portion is provided at the top end of the push button placed at a proper position on the handle, the bottom end of the push button is a fastening portion having a spring member allowing compressing and restoring, the inner seat after being mounted with a push button is inserted into the handle, the push button combined with the handle to form as one unit, the engagement of the fastening portion of the push button with the device provided on the runner provides a secured fastening of a closed umbrella.

2. A fastening assembly as set forth in claim wherein a recess is provided on the fastening portion of the push button for mounting a spring member.

3. A fastening assembly as set forth in claim 1, wherein the fastening portion is designed with an engaging region to adapt a "V" shaped elastic member.

4. A fastening assembly as set forth in claim 1, wherein one or more fastening holes or edges are provided at the lower portion of the runner for the engagement with the fastening portion of the push button.

5. A fastening assembly as set forth in claim wherein one or two push button are pivotally mounted to the inner seat.

* * * * *